US005152102A

United States Patent [19]

La See

[11] Patent Number: 5,152,102

[45] Date of Patent: Oct. 6, 1992

[54] CAM ADJUSTMENT DEVICE FOR ADJUSTABLE CASEMENT SASH UNIT

[76] Inventor: Jack C. La See, 308 W. Cedar St., Abbotsford, Wis. 54405

[21] Appl. No.: 813,597

[22] Filed: Dec. 26, 1991

[51] Int. Cl.[5] ..... E05D 15/30

[52] U.S. Cl. ..... 49/252; 49/396

[58] Field of Search ..... 49/252, 250, 251, 396, 49/260; 16/235, 239

[56] References Cited

U.S. PATENT DOCUMENTS 4,790,106 12/1988 La See ..... 49/252

5,074,075 12/1991 La See ..... 49/252

*Primary Examiner*—Philip C. Kannan

*Attorney, Agent, or Firm*—Herman H. Bains

[57] ABSTRACT

A track and hinge assembly for swingably mounting a casement sash unit in a window frame includes a track secured to the window frame and a toggle hinge interconnecting the track and the casement window sash. The toggle hinge includes a long toggle link and short toggle link interconnected together and slidably and pivotally connected to the track. The short toggle link is pivotally connected to the track by an adjustable pivot connection, including an octagonally-shaped cam positioned within an octagonal cam opening in the short toggle link. The octagonal cam has an eccentric opening therein through which the track pivot post projects. The octagonal cam may be removed from the cam opening in the short toggle link, and repositioned in the opening to shift the pivotal connection longitudinally of the short toggle link from a centered position in either direction to thereby overcome problems of sash sag during or after installation of the casement window unit.

7 Claims, 1 Drawing Sheet

CAM ADJUSTMENT DEVICE FOR ADJUSTABLE CASEMENT SASH UNIT

This invention relates to an adjustable casement sash unit, which is effective in correcting sash sag.

BACKGROUND OF THE INVENTION

One of the problems associated with residential casement windows is sash sag, which is the misalignment of the sash to the casement window frame. Sash sag is usually caused by poor installation of the window unit into the house or poor hinge positioning by the window manufacturer. Sash sag could be corrected during installation of the casement sash if the position of the hinge and track were adjustable. In most commercial casement sash units, the position of the hinge is not adjustable. In my U.S. Pat. No. 4,790,106, I have provided cam means, which permit slight longitudinal adjustment of the track and hinge assembly. Since the hinge is secured to the track, this adjustment also adjusts the toggle hinge for the casement sash.

SUMMARY OF THE INVENTION

It is an object of this invention to provide a conventional casement sash unit with a cam mechanism, which is adjustable for shifting the short toggle link of the toggle hinge relative to the track to thereby correct sash sag during or after installation of the casement window.

In carrying out this invention, the track and hinge assemblies for the casement sash unit each include the conventional toggle hinge mechanism, including a long toggle link and a short toggle link, which are pivotally interconnected together. The long toggle link is secured to the casement window and to a slide block, which slidably engages the track. The short toggle link is pivotally connected to an end portion of the track by a cam mechanism. The cam mechanism includes a pivot post secured to the track and engaged by a octagonal cam having an eccentric opening therein for accommodating the pivot post. The octagonal cam is selectively positionable in a octagonal opening in the end of the short toggle link to allow the position of the pivot axis between the short toggle link and the track to be adjusted. The adjustment of the position of the pivot axis between the short toggle link and track is sufficient to correct sash sag during or after installation of the casement window.

FIGURES OF THE DRAWING

DESCRIPTION OF THE PREFERRED EMBODIMENT

Figures 1, 2, 3, 4, 5, 6, 7, 8:
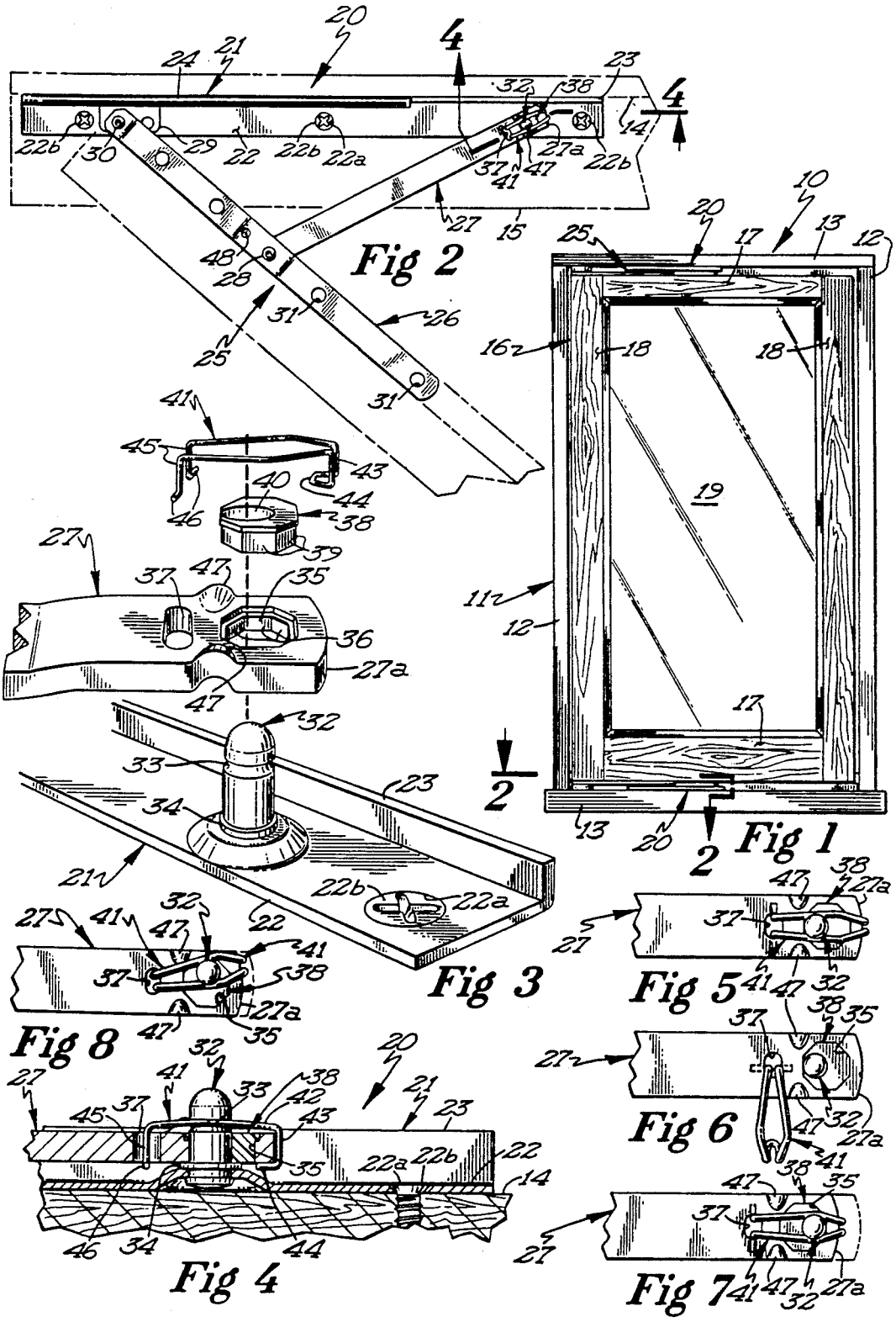
FIG. 1 is an elevational view of a casement window, incorporating the novel invention.
FIG. 2 is a plan view of a track and hinge assembly of the casement sash unit.
FIG. 3 is a fragmentary partially exploded perspective of a portion of the track and hinge assembly.
FIG. 4 is a cross-sectional view taken approximately along the lines 4—4 of FIG. 2 and looking in the direction of the arrows.
FIG. 5 is a plan view of a portion of the short toggle link, illustrating the cam means in one adjusted position.
FIG. 6 is a plan view of the short toggle link similar to FIG. 5, but illustrating the retaining clip in disengaged relation with respect to the pivot post.
FIG. 7 is a top plan view of the short toggle link similar to FIG. 5, but illustrating the cam means in another adjusted position.
FIG. 8 is a fragmentary top view similar to FIGS. 5-7, but illustrating the cam means in a centered or neutral position.

Referring now to the drawings and, more specifically, to FIG. 1, it will be seen that a casement window unit, designated generally by the reference numeral 10, is mounted in a conventional window frame 11. The window frame 11 includes laterally spaced apart vertical frame members 12, which are rigidly interconnected by upper and lower horizontal frame members 13. The upper and lower horizontal frame members 13 are provided with the conventional stop 14 and sill 15.

A casement window sash unit includes a casement window sash, designated generally by the reference numeral 16, and upper and lower track and hinge assemblies 20. The casement window sash includes upper and lower horizontal frame members 17, which are rigidly interconnected to vertical frame members 18. The casement window sash 16 includes a transparent pane 19, and is swingably mounted on the window frame 11 by the upper and lower track and hinge assemblies 20 to permit the casement window to be swung between the open and closed positions.

Each track and hinge assembly 20 comprises an elongate track 21, including an elongated horizontal track element 22, having a plurality of longitudinally spaced apart openings **22*a* therein through which project conventional screws 22*b*, for securing the track element to one of the horizontal frame members 13 of the casement window sash. Each elongated track 21 also includes a vertical track element 23, which is disposed at right angles to the horizontal track element 22, and which engages the conventional stop 14 of the horizontal frame member 13. Each vertical track element 23 has an arcuate overhanging portion 24 integrally formed therewith and extending longitudinally from one end of the elongated track 21** to a point located beyond the mid-portion of the track.

Each track and hinge assembly 20 also includes a toggle hinge 25 comprised of a long toggle link 26 and a short toggle link 27. The short toggle link 27 is pivotally connected to the long toggle link 26 intermediate the ends of the latter by a pivot 28. One end of the long toggle link 26 is pivotally connected by a pivot 30 to a slide block 29 of conventional construction, which slidably engages the arcuate overhang portion 24 of the vertical elongated track element 23 for sliding movement along the track 21. The long toggle link 26 is provided with a plurality of longitudinally spaced openings 31 therethrough for attachment to the horizontal frame member 17 of the casement window sash 16. In this regard, suitable screws secure the long toggle link 26 to the horizontal frame member 17 of the casement window sash 16.

The short link 27 has one end thereof pivotally connected to the elongated track 21 adjacent one end of the latter. This pivot connection between the short link 27 and track 21 also constitutes the cam means for adjustably positioning the pivotal axis between the short link and track. This pivot means includes a pivot post 32, which may be in the form of a rivet rigidly affixed to the horizontal track element 22 and projecting normally therefrom. The pivot post 32 has an annular groove 33 therein adjacent the outer end thereof and is also provided with an outwardly or radially extending element 34 located intermediate the groove 33 and the horizontal track element 22. The short toggle link 27 has an octagonally-shaped opening 35 defined by surfaces 36, which function as cam surfaces. The short link 27 also has a smaller opening 37 therein adjacent to, but spaced from, the octagonal opening 35. It will be noted that the octagonal opening 35 is disposed between the opening 37 and the adjacent end of the short link 27.

The pivot connection between the short toggle link 27 and track 21 also includes an octagonally-shaped cam 38 having flat peripheral cam surfaces 39, and having an eccentrically located opening 40 therethrough. The octagonally-shaped cam 38 is positioned within the octagonally-shaped opening 35 in the short toggle link 27. It will be seen that the flat peripheral surfaces 39 of the cam 38 mate with the surfaces 36, defining the octagonal opening 35. It is also pointed out that the cam 38 has flat upper and lower surfaces.

The cam 38 also accommodates the pivot post 32 through the eccentrically located opening 40 therein. The lower flat surface of the cam engages the radially extending stop element 34 on the pivot post to retain the cam in supported position thereon. Means are provided for retaining the cam in the octagonal opening in the short toggle link and on the pivot post 32, and this means includes an elongate spring clip 41. The spring clip includes a pair of elongate horizontal portions 42 having downwardly offset ends 43 that terminate in a terminal bight portion 44, which is bent back in the direction of the horizontal portion. The other end of the horizontal portions 42 downwardly offsets portions 45, which terminate in laterally extending terminal portions 46.

When the clip 41 is applied to the short toggle link 27, the offset portions 43 of the clip extend downwardly over the end edge 27*a* of the short toggle link 27, and the terminal portion 44 engages the lower surface of the short toggle link. The offset ends 45 of the spring clip 41 project into the opening 37, and the terminal portions 46 extend laterally therefrom and underlie the toggle link. It is pointed out that horizontal portions are urged outwardly by the pivot post 32, so that the horizontal portion of each spring clip clampingly engages in groove 33 of the pivot post to retain the cam and link in attached relation to the pivot post, but permitting swinging of the short toggle link 27 about an axis defined by the pivot post.

The upper or outer surface of the short link 27 is provided with a pair of opposed clip retaining elements 47, which are located laterally outwardly of, and on opposite sides of, the octagonal opening 35. In the embodiment shown, the clip retaining elements are struck upwardly from the short toggle link 27. Each retaining element is located outwardly of a horizontal portion of the spring clip 41 and retains the clip against disengagement from the short toggle link 27 and pivot post 32. These retaining elements also prevent accidental disassembly of the cam 38 from short toggle link 27 during shipment and installation of the hinge 20.

It will be noted that the angle defined between adjacent flat surfaces 39 of the octagonal cam 38 and adjacent flat surfaces 36, which defines the opening 35, is an angle of 45 degrees. It is also pointed out that the casement sash unit is usually pre-assembled so that the casement window sash 16 will have the upper and lower track and hinge assemblies 20 secured thereto. In the event that there is sash sag after installation of the casement window sash 16, the toggle hinge may be readily adjusted.

In making this adjustment, the casement window sash 16 will be opened to 90 degrees, and the short toggle link will be pried off the pivot post 32. In order to assure proper positioning of the short and long toggle links, a stop element 48 is integral with the long toggle link 26 intermediate the ends thereof. The stop element 48 is disposed in obstructing relation with respect to the short toggle link 27. Therefore, when the casement window sash is opened to 90 degrees, the short toggle link 27 will engage the stop element 48, and further movement of the casement window sash is prevented.

The wire spring clip will be rotated from its interlocking position, as illustrated in FIGS. 5, 7, and 8, through an arc of approximately 90 degrees, as illustrated in FIG. 6, to permit the cam 38 to be removed from the opening 35 and then repositioned in the latter. When the cam 38 is repositioned in the opening 35, the spring clip can again be moved into interlocking relation with respect to the pivot post and the short toggle link to the position illustrated in FIGS. 5, 7, and 8.

The hinge assembly 25 will be sold to window manufacturers with the cam 38 installed in the neutral position, as illustrated in FIG. 8. In this position, the pivot post 32 is centered with respect to the adjustments which may be made in either direction with respect to the position of the cam 38 in the cam opening 35. In this regard, if the cam 38 is indexed through an arc of 45 degrees, the adjustment of the short toggle link will be 0.044 of an inch in either direction, depending on the selected direction of adjustment. However, if the cam 38 is indexed through an arc of 90 degrees in either direction, the adjustment will be 1/16 of an inch in the selected direction.

FIGS. 5 and 6 illustrate the cam 38 having been indexed through an arc of 90 degrees from the centered or neutral position illustrated in FIG. 8 to thereby shift the pivot post 1/16 of an inch from the position illustrated in FIG. 8. On the other hand, the cam 38 has been shifted through an arc of 90 degrees in the opposite direction in FIG. 7 from the neutral position of FIG. 8. In the adjusted position of FIG. 7, the relative position of the pivot post and short toggle link has been shifted 1/16 of an inch from the neutral position and approximately ⅛ of an inch from the position illustrated in FIGS. 5 and 6. It will also be appreciated that, by shifting the cam 38 through an arc of 45 degrees, an adjustment of 0.004 inch can be obtained with respect to the pivot post and short toggle link.

After installation, if there is sash sag, the short toggle link will have to be shifted longitudinally to correct the sash sag. Since an adjustment of up to 1/16 inch can be made in either direction from the centered or neutral position, this amount of adjustment is sufficient to correct most sash sag conditions experienced during typical installations.

It is also pointed out that some users of casement hinges buy the track assemblies 21 disassembled from the toggle hinge 25. The use of the retention elements 47 prevents accidental disassembly of these small parts during shipment and installation of the hinge. This particular cam adjustment device acts directly on the toggle hinge and permits an installer to readily adjust the casement window sash unit during or after installation. The entire adjustment requires no special tools and may be readily accomplished with a minimum of effort and in a minimum amount of time. However, the adjustment is sufficient to overcome substantially all sash sag conditions, which are normally experienced in the field during installation of the window sash units. The present invention provides an alternative means of adjusting a window sash unit, when compared with the cam mechanism disclosed and claimed in U.S. Pat. No. 4,790,106.

What is claimed is:

1. In combination with a casement window sash, a pair of track and hinge assemblies swingably mounting the casement window sash on a window frame to permit swinging movement of the casement window sash between open and closed positions, each track and hinge assembly including an elongate track, a toggle hinge including an elongate long toggle link and an elongate short toggle link, means pivotally connecting one end portion of said short toggle link to the long toggle link intermediate the ends of the latter, means slidably interconnecting one end of said long toggle link with said track, means connecting the long toggle link with the casement window sash, adjustable pivot means connecting the other end of said short toggle link to one end portion of said track, said adjustable pivot means including a pivot post secured to one end of said track, said short toggle link having a cam opening in the other end portion thereof, said cam opening defining a cam surface, and a cam element having a peripheral surface shaped and sized to mate with the cam surface defined by the cam opening in the short toggle link, said cam element having an eccentric opening therein through which the pivot post projects to pivotally connect the short toggle link to the track and permit pivoting movement of the short toggle link relative to the track, said cam element having a neutral position wherein the cam element is located in a predetermined position in said cam opening, said cam, when removed from the cam opening in the short toggle link and indexed through an arc of either 45 or 90 degrees in either direction and then repositioned in the cam opening, shifting said pivotal axis between the short toggle link and track at a predetermined magnitude in either direction longitudinally of the short toggle link to thereby adjust the casement window sash relative to the window frame.

2. The invention as defined in claim 1 wherein said cam and said cam opening are of octagonal configuration.

3. The invention as defined in claim 2 and a retaining spring clip engaging said short toggle link and said cam for releasably retaining the latter in the cam opening in said short toggle link.

4. The invention as defined in claim 3 and a pair of spring clip retaining elements on said short toggle link positioned adjacent to, but outwardly of, said retaining spring clip for retaining the latter against accidental disengagement from said short toggle link.

5. The invention as defined in claim 3 wherein said pivot post has an annular groove therein, said retaining spring means engaging said pivot post in said annular groove.

6. The invention as defined in claim 3 and a stop element on said pivot post engaging said cam and positioning the latter in the cam opening in said short toggle link.

7. A track and hinge assembly for swingably attaching a casement window sash to a window frame, comprising;

an elongate track, a toggle hinge including an elongate long toggle link and an elongate short toggle link, means pivotally connecting one end portion of said short toggle link to the long toggle link intermediate the ends of the latter, means for connecting the long toggle link with a casement window sash, adjustable pivot means connecting the other end of said short toggle link to one end portion of said track, said adjustable pivot means including a pivot post secured to one end of said track, said short toggle link having a cam opening in the other end portion thereof, said cam opening defining a cam surface, and a cam element having a peripheral surface shaped and sized to mate with the cam surface defined by the cam opening in the short toggle link, said cam element having an eccentric opening therein through which the pivot post projects to pivotally connect the short toggle link to the track and permit pivoting movement of the short toggle link relative to the track, said cam having a neutral position wherein the cam element is located in a predetermined position in said cam opening, said cam, when removed from its neutral position in the cam opening of the short toggle link and indexed through an arc of 45 or 90 degrees in either direction and then repositioned in the cam opening, shifting said pivotal axis between the short toggle link and track at a predetermined magnitude in either direction longitudinally of the toggle link for adjusting a casement window sash relative to the window frame.

* * * * *

UNITED STATES PATENT AND TRADEMARK OFFICE

CERTIFICATE OF CORRECTION

PATENT NO. : 5,152,102

DATED : October 6, 1992

INVENTOR(S) : Jack C. La See

It is certified that error appears in the above-indentified patent and that said Letters Patent is hereby corrected as shown below:

Column 4, line 49, delete "0.004" and insert --0.044-- therefor.

Signed and Sealed this

Twenty-eighth Day of September, 1993

*Attest:*

BRUCE LEHMAN

*Attesting Officer*

*Commissioner of Patents and Trademarks*